United States Patent [19]

Christensen

[11] 4,148,361

[45] Apr. 10, 1979

[54] FOAM DELIVERY SYSTEM FOR A FLOATING ROOF TANK

[75] Inventor: Harold V. Christensen, Bartlesville, Okla.

[73] Assignee: Phillips Petroleum Company, Bartlesville, Okla.

[21] Appl. No.: 799,031

[22] Filed: May 20, 1977

[51] Int. Cl.[2] ..... A62C 37/06

[52] U.S. Cl. ..... 169/66; 220/88 B; 220/219

[58] Field of Search ..... 169/66, 67, 68; 220/219, 88 B

[56] References Cited

U.S. PATENT DOCUMENTS

| | | | |
|---|---|---|---|
| 1,844,373 | 2/1932 | Urquhart | 169/66 |
| 2,079,438 | 5/1937 | Ellis | 169/66 |
| 2,548,409 | 4/1951 | Trotter et al. | 169/66 |
| 3,154,214 | 10/1964 | Baker | 220/219 |
| 3,690,502 | 9/1972 | Guber, Jr. | 220/219 |
| 3,741,309 | 6/1973 | McCulloch | 169/66 |

FOREIGN PATENT DOCUMENTS

| | | | |
|---|---|---|---|
| 568419 | 3/1924 | France | 169/66 |
| 712086 | 7/1966 | Italy | 169/68 |
| 568811 | 4/1945 | United Kingdom | 169/66 |

*Primary Examiner*—John J. Love
*Assistant Examiner*—Michael J. Forman

[57] ABSTRACT

A storage tank such as those used to store petroleum products has a floating roof for the top closure and a seal between the roof and the tank sidewall for sealing the space and allowing relative movement therebetween. A conduit system is provided for the delivery of foam to the seal area in the event of a fire so as to extinguish the flame which is normally present in the seal area. The foam delivery system includes a conduit which preferably is flexible and functions both as a roof drain conduit and a foam delivery conduit which by a valve mechanism selectively allows draining of water from the roof or the delivery of foam to the roof.

7 Claims, 4 Drawing Figures

FOAM DELIVERY SYSTEM FOR A FLOATING ROOF TANK

The present invention relates to a fire extinguishing fluid delivery system for use in storage tanks wherein one conduit functions both as a drain conduit and a fluid delivery conduit. The conduit normally functions as a drain conduit by allowing water or other collected fluids to be drained from the roof. The conduit is also used as the conduit for delivering foam to a dispensing conduit system for discharging the fire extinguishing fluid to the seal area between the roof and the interior surface of the tank. Normally, petroleum storage tanks have a floating roof which rises and falls with the level of the liquid contained therein and a seal is provided between the roof and the interior surface of the tank at which area a fire can occur. Delivery systems are known in the art for delivering fire extinguishing fluid to the seal area and same function effectively for fighting a fire on the roof of the tank. The fluid in use is discharged into a reservoir formed between a dam on the roof and the wall of the tank and effectively extinguishes a fire. The common feature of the prior art apparatuses is that two conduits are provided, i.e., one for draining collected water from the roof of the tank and one for conveying a fire extinguishing fluid to the roof of the tank. Such conduits are normally expensive since same must be flexible so as to move with the roof during rising and falling. The present invention provides an apparatus which permits dual usage of one flexible conduit for both drainage and fire extinguishing fluid conveying.

The principal objects and advantages of the present invention are: to provide an apparatus which serves the dual function of a drain conduit and a fire extinguishing fluid conveying conduit, thereby eliminating the need for a plurality of flexible conduits within a tank; to provide an apparatus which can have a fire extinguishing fluid source quickly connected thereto in a releasable manner so that a permanent installation of a fluid container is not necessary for each tank; and to provide an apparatus which is well adapted for its intended use, economical to manufacture and easy to maintain and operate.

Other objects and advantages of the present invention will become apparent from the following detailed description taken in connection with the accompanying drawings wherein are set forth by way of illustration and example, certain embodiments of this invention.

Figure 1:
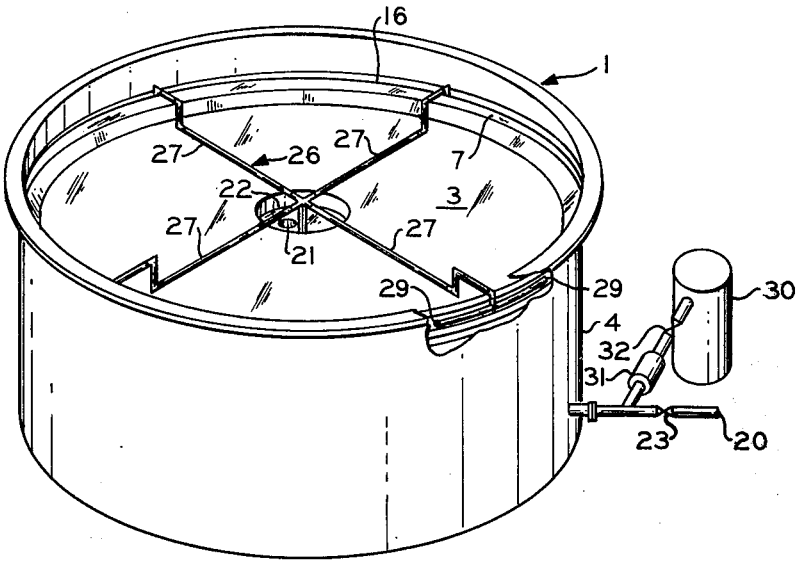
FIG. 1 is a perspective view of a tank with a floating roof having a combination drain and fire extinguishing fluid delivery system.
Figure 2:
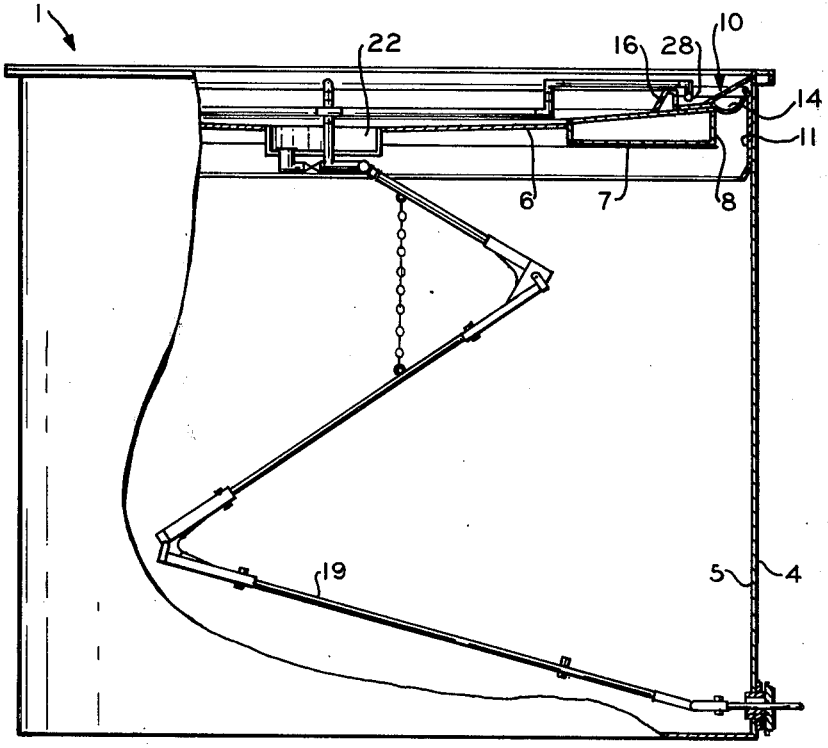
FIG. 2 is a sectional view of the tank showing details of the conduit system.
Figure 3:
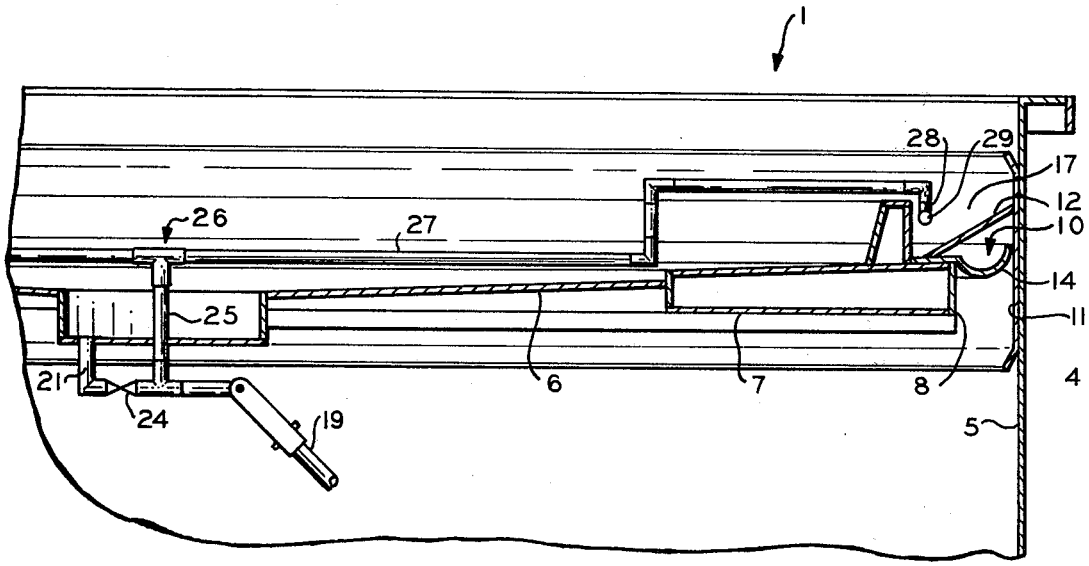
FIG. 3 is an enlarged fragmentary sectional view of a portion of the tank showing structural details thereof.

Referring more in detail to the drawings:

The reference numeral 1 designates generally a tank structure which includes a floating roof 3. Such structures are well known in the art and therefore a detailed description of same is not necessary. The tank 1 has a side wall 4 with an interior surface and preferably is circular as is the roof 3. The roof 3 fits within the sidewall 4 and has a bottom wall 6 extending substantially across the width of the tank 1 and has generally the same shape as the interior of the tank. A flotation collar

7 is provided so that the roof 3 will float. The peripheral edge 8 of the roof 3 is spaced inwardly from the wall 5 a distance sufficient to provide binding free raising and lowering of the roof 3 in response to a change in the level of the contents contained in the tank. The spacing distance is usually kept at a minimum with the diameter of the roof being, for example, at least 90% of the diameter of the tank sidewall 4. Such contents are normally a mixture of hydrocarbons which is flammable.

Seal means 10 is provided between the peripheral edge of the roof 3 and the sidewall 4 so as to prevent loss of vapor or liquid from the tank and to prevent exposure of the contents to the atmosphere. As shown, the seal means 10 includes a shoe 11 which slidably engages the surface 5 with the shoe 11 being supported by one or more support members 12 secured thereto and in supporting engagement with a portion of the roof 3. The seal means 10 includes a flexible circumferentially continuous annular seal 14 which is secured to and extends between a peripheral portion of the roof 3 and the shoe 11. The seal means 10 as described above preferably extends around the entire periphery of the roof 3 to form a complete seal for the space between the roof 3 and inner wall surface 5. Such structures are well known in the art. A circumferentially continuous dam forming member 16 is secured to a portion of the roof 3 extending upwardly therefrom and is spaced inwardly from the surface 5, forming an annular reservoir 17 between the dam 16 and wall 4. In the event of a fire, a fire extinguishing fluid, which preferably is a foam, can be discharged into the reservoir 17 as described below to extinguish a flame and prevent the flame from traveling down into the tank 2.

The fire extinguishing fluid, hereinafter referred to as foam, is delivered by a foam delivery system which serves a dual function of also being a drain for the roof 3. A conduit 19 has relatively movable portions as for example flexible, or telescoping, hereinafter referred to as flexible, and has opposite ends 20 and 21 with the lower end 20 being positioned adjacent to a lower disposed portion of the tank 2 and the upper end 21 opening onto the roof 3. The conduit 19 can be of any suitable type such as, for example, that conduit disclosed in U.S. Pat. No. 3,154,214, issued Oct. 27, 1964 which although having rigid sections, has flexible elbows to provide flexing of the conduit so that the roof can raise and lower as described above. Preferably, the end 21 opens into a low spot of the roof 3 such as a recess 22 so that any water accumulating on the roof 3 will flow to the low spot and be discharged through the conduit 19 flowing from the upper end 21 to the lower end 20. The end 20 of the conduit can have a valve 23 connected to the conduit 19 so as to selectively allow discharge of drainage water therefrom. The valve 23 can be of an on/off type or can also be of an automatic type which selectively allows the discharge of water in preference to another liquid such as that valve disclosed in U.S. Pat. No. 3,074,587, issued Jan. 22 1963. Preferably, there is a valve 24, of the check valve type, connected in the conduit 19 adjacent the upper end 21. The valve 24 is such as to allow the flow of water from the end 21 and out the end 20 but prevents reverse flow of a fluid flowing from the end 20 and out the end 21. A foam delivery conduit means 26 is connected in flow communication to the conduit 19, by a conduit 25, between the valve 24 and the end 20 and adjacent the end 21 whereby a substantial portion of the conduit 19 is between the conduit 25 connection and the end 20 or the point at which the conduit 19 extends through the sidewall 4. The conduit means 26, as illustrated, includes a plurality of conduits 27 connected to the conduit 19 with each going to a different area of the reservoir 17 to quickly provide a uniform distribution of dispensed foam. Each of the conduits 27 has a discharge member 28 opening for discharge of foam into the reservoir 17. Each discharge 28 can have one or more points of discharge 29 to more quickly distribute foam into the reservoir 17.

A foam supply 30 can be releasably connected to the conduit 19 or permanently connected thereto and is operable for the supplying of foam into the conduit 19 upon demand for discharge into the reservoir 17 after flowing through the conduit means 19 and 26. Preferably, the supply 30 is releasably connected to the conduit 19 via a quick connect coupling 31 of a suitable type known in the art whereby one supply 30 can be available for use on more than one tank or be moved to a tank only in time of need thereby reducing capital investment and the number of supplies 30 required. Preferably, the quick connect coupling 31 is connected to the conduit 19 between the valve 23 and the point of communication between the conduit means 26 and the conduit 19. This would prevent accidental discharge of the foam out the end 20. For a permanent connection, if desired, a check valve (not shown) could be positioned between the conduit 19 and the supply 30 to prevent flow of water to the supply 30 rather than out the end 20. A valve 32 is connected between the coupling 31 and the source 30 and can be either manually operable or remotely operable to selectively allow the discharge of foam from the supply 30 into the conduit 19.

The present invention is more fully understood by a description of the operation thereof. Normally, the conduit 19 provides a drain for the roof 3 by virtue of the fact that the valve 24 is in an open flow position for flow from the end 21 to the end 20. If water should accumulate on the roof 3, same would be discharged through the conduit 19. In the event of a fire, the valve 32 is opened after the supply 30 is connected to the conduit 19 at the quick connect 31 and the foam flows through the conduit 19 and into the conduit means 26 for discharge through the discharges 28. After the fire has been extinguished, the foam can be turned off by closing the valve 32.

Figure 4:
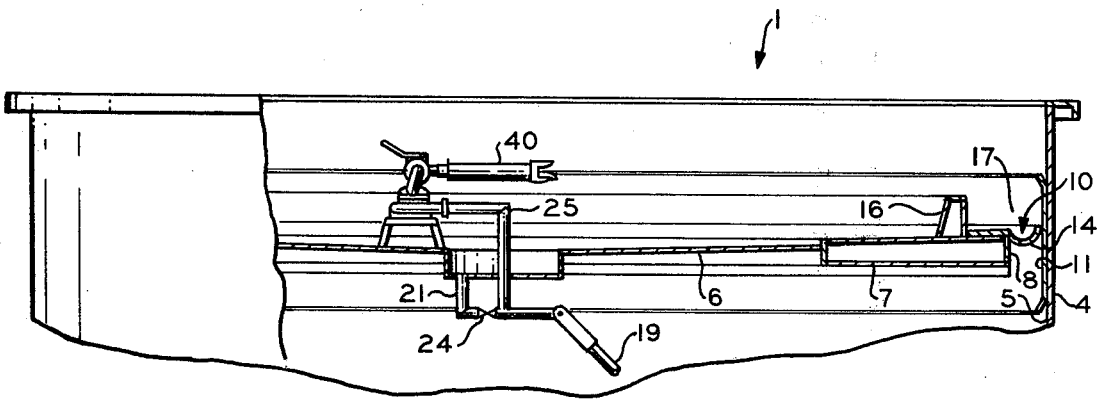
FIG. 4 is a fragmentary side elevational view of a modified form of the invention.

A modified form of the present invention is shown in FIG. 4 wherein the same or similar parts or structure is denoted by the same reference numerals used in the form described above. The main difference is that the conduit means 26 and discharges 28 are replaced by a turret mounted foam discharge means such as a gun 40 such as the Rockwood monitor Model LWP 500 which would discharge the foam, from a central position on the roof, through the gun out into the atmosphere and into the reservoir 17. By rotating, the gun 40 will dispense foam into all areas of the reservoir 17.

A third alternative would be to replace the conduit means 26 and discharges 28 with hand held discharges such as hoses with nozzles.

It is to be understood that while I have illustrated and described certain forms of my invention, it is not to be limited to the specific form or arrangement of parts herein described and shown except to the extent that such limitations are in the claims.

What is claimed and desired to be secured by Letters Patent is:

1. An apparatus for delivering foam to a floating roof of a tank, said apparatus including:

a tank;

a floatable roof movably received in said tank, said roof having an upwardly facing surface and a sliding seal forming a seal between a peripheral portion of the roof and a portion of the tank;

first conduit means having a first end and a second end with said first end being positioned adjacent a lower disposed portion of said tank, and said second end being open and opening onto said upwardly facing surface;

a first valve means cnnected in said first conduit means between said first end and said second end, said first valve means being operable for preventing flow from the first end to the second end and allowing flow from the second end to the first end;

second conduit means connected to and opening into said first conduit means between said first end and said first valve means for continuous flow communication with said first conduit means whereby said first conduit means is always in flow communication with said second conduit means, said second conduit means having at least one portion operable for dispensing foam from the first conduit means onto a portion of the roof; and first means cooperating with said first conduit means adjacent the first end adapted for allowing flow of fire extinguishing fluid into the first conduit means for flow to the second conduit means.

2. An apparatus as set forth in claim 1 including:

second valve means connected in said first conduit means adjacent said first end with said second valve means being operable for selectively preventing flow of fire extinguishing fluid through the second valve means; and wherein said first means has a portion connected to and opening into said first conduit means between said second conduit means and said second valve means.

3. An apparatus as set forth in claim 2 wherein:

said first means includes third conduit means with a third valve means connected in the third conduit means, said third valve means is operable for selectively allowing flow of fire extinguishing fluid through said third conduit means to the first conduit means.

4. An apparatus as set forth in claim 2 including:

a dam on said roof spaced inwardly from said seal means and having a height for forming a fluid reservoir between said dam and a portion of said tank; and wherein said discharge opens into said reservoir.

5. An apparatus as set forth in claim 4 wherein:

there is a plurality of said discharge with said discharges being spaced apart around said reservoir.

6. An apparatus as set forth in claim 4 wherein:

said roof has an area lower than the remainder of the roof with said second end opening into said area.

7. An apparatus as set forth in claim 2 wherein:

said first means includes a quick connect coupling adapted for releasably connecting a source of fire extinguishing fluid to said first conduit means.

* * * * *